US010902782B2

(12) United States Patent
Park

(10) Patent No.: US 10,902,782 B2
(45) Date of Patent: Jan. 26, 2021

(54) ORGANIC LIGHT EMITTING DISPLAY DEVICE

(71) Applicant: LG DISPLAY CO., LTD., Seoul (KR)

(72) Inventor: Joonmin Park, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/521,030

(22) Filed: Jul. 24, 2019

(65) Prior Publication Data

US 2020/0035165 A1 Jan. 30, 2020

(30) Foreign Application Priority Data

Jul. 24, 2018 (KR) ..... 10-2018-0086084

(51) Int. Cl.
*G09G 3/3258* (2016.01)
*G09G 3/3266* (2016.01)
*G09G 3/3233* (2016.01)

(52) U.S. Cl.
CPC ..... *G09G 3/3258* (2013.01); *G09G 3/3233* (2013.01); *G09G 3/3266* (2013.01); *G09G 2300/0426* (2013.01); *G09G 2310/0202* (2013.01); *G09G 2310/0251* (2013.01); *G09G 2320/0233* (2013.01); *G09G 2320/0252* (2013.01)

(58) Field of Classification Search
CPC .. G09G 3/3258; G09G 3/3233; G09G 3/3241; G09G 3/325; G09G 3/3266; G09G 2300/0426; G09G 2300/043; G09G 2300/0819; G09G 2310/0202; G09G 2310/0251; G09G 2320/0233; G09G 2320/0252
See application file for complete search history.

(56) References Cited

U.S. PATENT DOCUMENTS

| | | | | |
|---|---|---|---|---|
| 9,728,129 | B2 * | 8/2017 | Lee | G09G 3/3233 |
| 2006/0214893 | A1 * | 9/2006 | Tseng | G09G 3/3233 345/82 |
| 2010/0321364 | A1 * | 12/2010 | Chang | G09G 3/3614 345/211 |
| 2014/0320385 | A1 * | 10/2014 | Kwon | G09G 3/3233 345/82 |
| 2015/0028762 | A1 * | 1/2015 | Qi | H01L 27/1255 315/210 |
| 2017/0013221 | A1 * | 1/2017 | Yanagida | H04N 5/3532 |
| 2017/0032736 | A1 * | 2/2017 | Gu | G09G 3/3208 |
| 2017/0221419 | A1 * | 8/2017 | Xiang | G09G 3/3233 |
| 2018/0053462 | A1 * | 2/2018 | Bae | G09G 3/2074 |

(Continued)

FOREIGN PATENT DOCUMENTS

KR 10-2018-0014389 A 2/2018

*Primary Examiner* — Tom V Sheng
(74) *Attorney, Agent, or Firm* — Seed IP Law Group LLP

(57) ABSTRACT

Various embodiments provide is an organic light emitting display device including a first pixel having a first organic light emitting diode (OLED) and a first driving transistor and a second pixel having a second OLED and a second driving transistor. The first pixel and the second pixel are electrically connected to a first data line. A source electrode of the first driving transistor is electrically connected to a first reference voltage line, and a source electrode of the second driving transistor is electrically connected to a second reference voltage line.

12 Claims, 13 Drawing Sheets

(56) References Cited

U.S. PATENT DOCUMENTS

| | | | | |
|---|---|---|---|---|
| 2018/0197468 | A1* | 7/2018 | Wu | G09G 3/3275 |
| 2018/0350302 | A1* | 12/2018 | Han | G09G 3/003 |
| 2019/0197958 | A1* | 6/2019 | Yen | G09G 3/3233 |
| 2020/0152126 | A1* | 5/2020 | Jo | G09G 3/3225 |

* cited by examiner

ORGANIC LIGHT EMITTING DISPLAY DEVICE

CROSS-REFERENCE TO RELATED APPLICATION(S)

This application claims the benefit of Korea patent application no. 10-2018-0086084, filed Jul. 24, 2018, the entire contents of which is incorporated herein by reference for all purposes as if fully set forth herein.

BACKGROUND

Technical Field

The present disclosure relates to an organic light emitting display device in which brightness deviation (or luminance deviation) is improved.

Description of the Related Art

An active matrix type organic light emitting display device includes a self-luminous organic light emitting diode (OLED), has a high response speed, has high luminous efficiency and brightness, and has a wide viewing angle.

The OLED, which is a self-luminous element, includes an anode electrode, a cathode electrode, and organic compound layers (HIL, HTL, EML, ETL, and EIL) formed therebetween. The organic compound layer includes a hole injection layer (HIL), a hole transport layer (HTL), an emission layer (EML), an electron transport layer (ETL), and an electron injection layer (EIL). When a power supply voltage is applied to the anode electrode and the cathode electrode, holes passing through the HTL and electrons passing through the ETL migrate to the EML to form excitons, and as a result, the EML emits visible light.

Pixels of the organic light emitting display device each include an OLED and a driving transistor and represents brightness in gray levels of image data. To this end, the driving transistor controls a driving current flowing in the OLED according to a voltage applied between a gate electrode and a source electrode thereof. The amount of light emission of the OLED is determined according to the driving current and brightness of an image is determined according to the amount of light emission of the OLED.

The gate-source voltage of the driving transistor is determined by a data voltage and a reference voltage. In order to obtain desired brightness, the reference voltage supplied to all the pixels must be constant, but the reference voltage applied to adjacent lines may be varied depending on the driving method. If the reference voltage applied to the pixels is different, brightness is varied although the same data voltage is supplied, causing brightness deviation (or luminance deviation) between the lines.

BRIEF SUMMARY

In various embodiments of the present disclosure, an organic light emitting display device includes a first data line; a first reference voltage line; a second reference voltage line; and a plurality of pixels electrically connected to the first data line. The plurality of pixels are n pixels and divided into a first set of pixels and a second set of pixels. Each of the first set of pixels is electrically connected to the first data line and the first reference voltage line. Each of the second set of pixels is electrically connected to the first data line and the second reference voltage line. Each of the first set of pixels is spaced from another one of the first set of pixels by one of the second set of pixels. The first and second reference voltage lines are configured to receive a reference voltage having the same voltage level. The organic light emitting display device further includes a gate driver configured to, during an image data write interval, provide scan signals and sense signals to perform overlap driving of a k-th pixel and a (k+1)-th pixel of the plurality of pixels, and to perform an non-overlap driving of a n-th pixel of the plurality of pixels, where n is a natural number larger than or equal to 2, and k is a natural number smaller than n.

BRIEF DESCRIPTION OF THE SEVERAL VIEWS OF THE DRAWINGS

The accompanying drawings, which are included to provide a further understanding of the present disclosure and are incorporated in and constitute a part of this specification, illustrate embodiments of the present disclosure and together with the description serve to explain the principles of the present disclosure. In the drawings.

DETAILED DESCRIPTION

Figure 1:
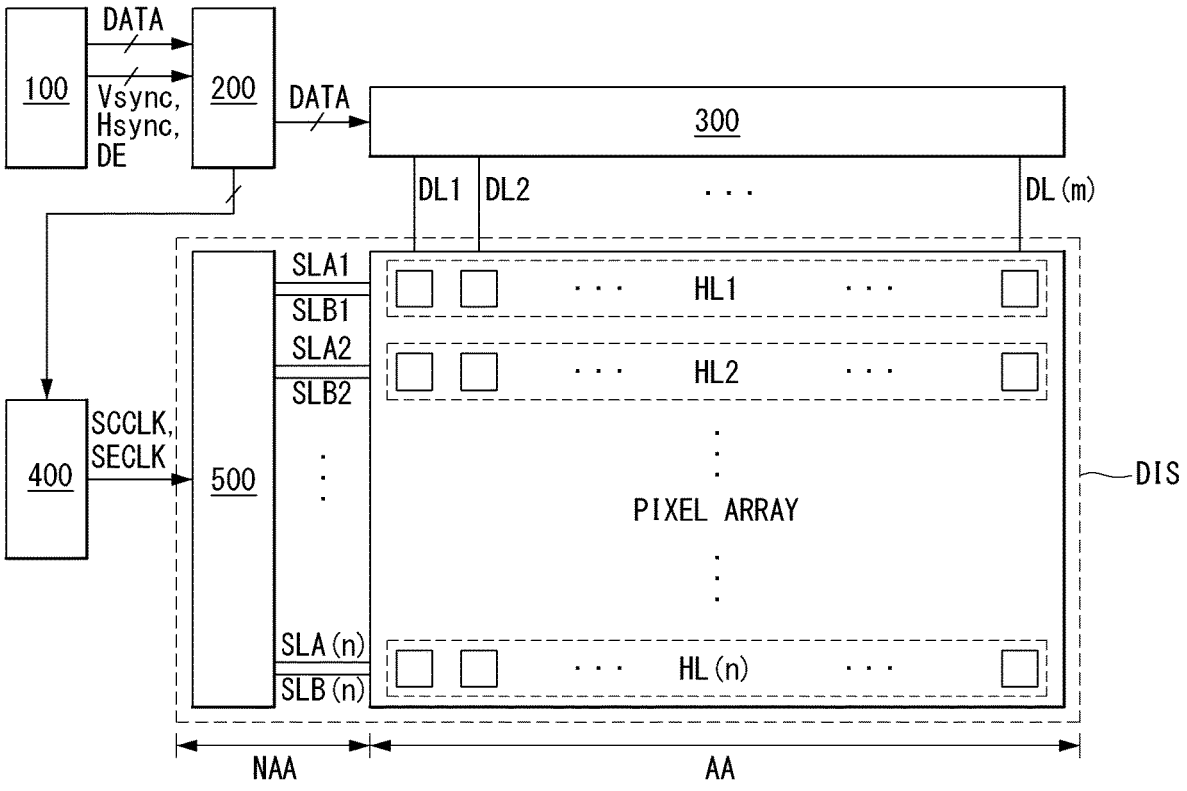
FIG. 1 is a view illustrating an organic light emitting diode display according to an embodiment of the present disclosure.

Hereinafter, embodiments of the present disclosure will be described in detail with reference to the accompanying drawings. Like reference numerals refer to like elements throughout the specification. Further, in the description of the present disclosure, detailed description of known related arts will be omitted if it is determined that the gist of the present specification is unnecessarily obscured.

In the present disclosure, switching elements may be realized as transistors having an n type or p type metal oxide semiconductor field effect transistor (MOSFET) structure. The transistor is a three-electrode element including a gate, a source, and a drain. The source is an electrode that supplies a carrier to the transistor. In the transistor, carriers start to flow from the source. The drain is an electrode through which the carriers exit from the transistor. That is, in the MOSFET, the carriers flow from the source to the drain. In the case of the n-type MOSFET (NMOS), the carriers are electrons, and thus, a source voltage is lower than a drain voltage so that electrons may flow from the source to the drain. In the n-type MOSFET, electrons flow from the source to the drain, and thus, current flows from the drain to the source. In contrast, in the case of a p-type MOSFET (PMOS), since carriers are holes, a source voltage is higher than a drain voltage so that holes may flow from the source to the drain. In the p-type MOSFET, since holes flow from the source to the drain, current flows from the source to the drain. It should be noted that the source and the drain of the MOSFET are not fixed. For example, the source and the drain of the MOSFET may be changed depending on an applied voltage. Therefore, in the following embodiments, the present disclosure is not limited by the source and the drain of the transistor.

FIG. 1 is a block diagram schematically illustrating an organic light emitting display device according to an embodiment of the present disclosure.

Referring to FIG. 1, an organic light emitting display device according to an embodiment of the present disclosure includes a display panel DIS having pixels P formed therein, a timing controller 200 for generating a timing control signal, a gate driver including a level shifter 400 and a shift register 500 for driving scan lines SLA1 to SLA(n) and sense lines SLB1 to SLB(n), and a data driver 300 for driving data lines DL1 to DL(m).

The display panel DIS includes a display area AA in which pixels P are arranged to display an image and a non-display area NAA in which no image is displayed. A shift register 500 may be disposed in the non-display area NAA. In FIG. 1, the non-display area NAA indicates the area where the shift register 500 is disposed but the non-display area NAA refers to a bezel surrounding the edge of the pixel array.

The pixels P are arranged in a matrix form in the display area AA of the display panel DIS. Each of the pixel lines HL1 to HL(n) includes pixels arranged in the same row. When the number of pixels P arranged in the display area AA is m×n, the display area AA includes n pixel lines. In this disclosure, each of the pixels P refers to a red subpixel, a green subpixel, or a blue subpixel for color representation. The transistors constituting the pixels P may be implemented as oxide transistors including an oxide semiconductor layer. The oxide transistor is advantageous for a large-sized display panel DIS in consideration of both electron mobility and process variation. However, the present disclosure is not limited thereto, and the semiconductor layer of the transistor may be formed of amorphous silicon, polysilicon, or the like.

The pixels P arranged in a first pixel line HL1 are electrically connected to a first scan line SLA1 and a first sense line SLB1, and the pixels P arranged in an nth pixel line HL(n) are electrically connected to an nth scan line SLA(n) and nth sense line SLB(n). The scan lines SLA1 to SLA(n) and sense lines SLB1 to SLB(n) are for providing respective gate signals.

The timing controller 200 rearranges input image data (or input video data) DATA provided from a host 100 according to resolution of the display panel DIS and supplies the rearranged image data to the data driver 300. The timing controller 200 also generates a data control signal for controlling an operation timing of the data driver 300 on the basis of timing signals such as a vertical synchronization signal Vsync, a horizontal synchronization signal Hsync, a data enable signal DE, and the like.

The data driver 300 converts input image data DATA received from the timing controller 200 into an analog data voltage on the basis of the data control signal.

As described above, the gate driver includes a level shifter 400 and a shift register 500. The level shifter 400 generates a scan clock signal SCCLK and a sense clock signal SECLK on the basis of a gate control signal provided from the timing controller 200. The shift register 500 generates scan signals, while sequentially shifting the scan clock SCCLK output from the level shifter 400, and provides the generated scan signals to the scan lines SLA1 to SLA(n). The shift register 500 generates sense signals, while sequentially shifting the sense clock SECLK, and provides the generated sense signals to the sense lines SLB1 to SLB(n). To this end, the shift register 500 includes stages which are dependently connected to each other. The shift register 500 may be formed directly on the non-display area NAA of the display panel DIS using a gate-driver in panel (GIP) process.

Figure 2:
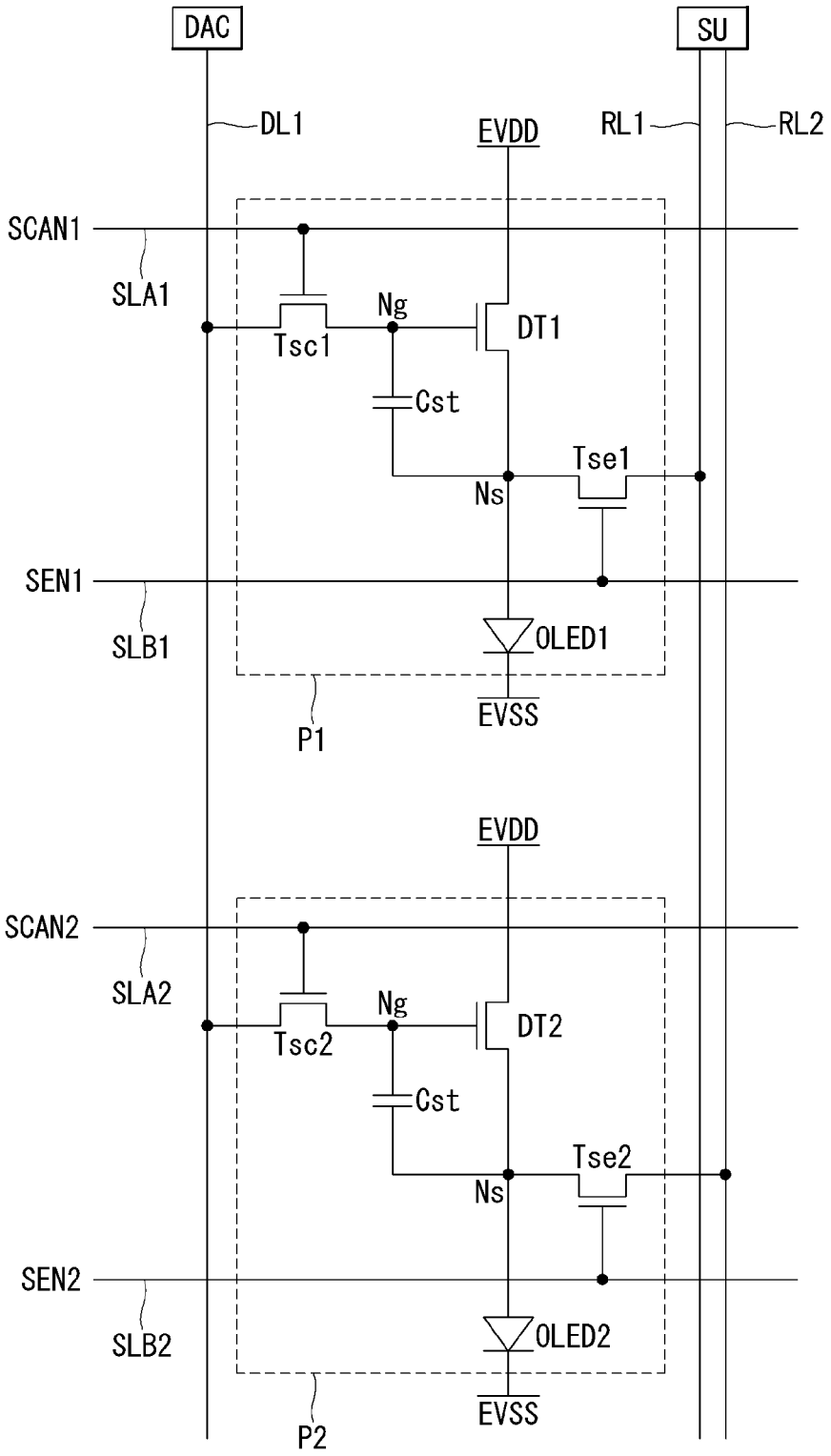
FIG. 2 is a circuit diagram of first and second pixels electrically connected to the same data line according to an embodiment of the present disclosure.

FIG. 2 is a view illustrating an embodiment of a first pixel arranged in a first pixel line and a second pixel arranged in a second pixel line according to an embodiment of the present disclosure. FIG. 2 shows the pixels electrically connected to a first data line.

Referring to FIG. 2, a first pixel P1 includes a first organic light emitting diode OLED1, a first driving transistor DT1, a storage capacitor Cst, a first scan transistor Tsc1, and a first sense transistor Tse1. The first driving transistor DT1 controls a driving current flowing at the organic light emitting diode OLED according to a gate-source voltage Vgs. The driving transistor DT includes a gate electrode electrically connected to a first node Ng, a drain electrode electrically connected to an input terminal of a high potential driving voltage EVDD, and a source electrode electrically connected to a second node Ns. The storage capacitor Cst is electrically connected between the first node Ng and the second node Ns. The first scan transistor Tsc1 includes a gate electrode electrically connected to a first scan line SLA1, a drain electrode electrically connected to a first data line DL1, and a source electrode electrically connected to the first node Ng. The first sense transistor Tse1 includes a gate electrode electrically connected to a first sense line SLB1, a drain electrode electrically connected to the second node Ns, and a source electrode electrically connected to a first reference voltage line RL1.

Similarly, the second pixel P2 includes a second organic light emitting diode OLED2, a second driving transistor DT2, a storage capacitor Cst, a second scan transistor Tsc2, and a second sense transistor Tse2. A connection relationship of the second organic light emitting diode OLED2, the second driving transistor DT2, the storage capacitor Cst, and the second scan transistor Tsc2 in the second pixel P2 is similar to a connection relationship of the first pixel P1, and thus, a detailed description thereof will be omitted. The second sense transistor Tse2 includes a gate electrode electrically connected to a second sense line SLB2, a drain electrode electrically connected to the second node Ns, and a source electrode electrically connected to a second reference voltage line RL2.

The first data line DL1 is supplied with a data voltage through a digital-to-analog converter (DAC) of the data driver 300, and the first and second reference voltage lines RL1 and RL2 are electrically connected to a sensing unit SU. The sensing unit SU supplies a reference voltage through the first and second reference voltage lines RL1 and RL2 of the pixel, or acquires a first node Ng voltage of each of the first pixel P1 and the second pixel P2, as a sensing voltage. Hereinafter, any known method for acquiring the sensing voltage and compensating for driving characteristics on the basis of the sensed voltage may be used, and thus, a detailed description thereof will be omitted here.

In the organic light emitting display device according to the present disclosure, a technique of inserting a black image may be applied to shorten a moving picture response time (MPRT). A black data insertion (BDI) technique is used to effectively erase an image of a previous frame by displaying a black image between neighboring image frames.

Figure 3:
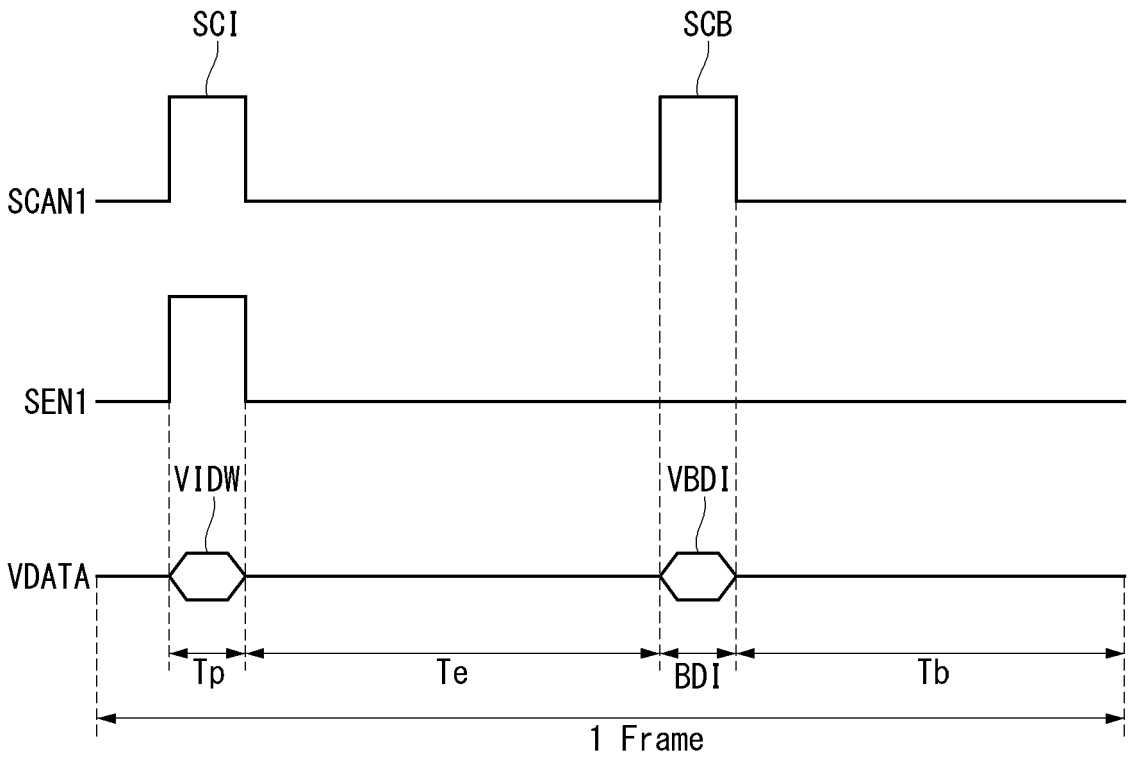
FIGS. 3 to 5 are views illustrating black data insertion driving according to an embodiment of the present disclosure.
Figure 4:
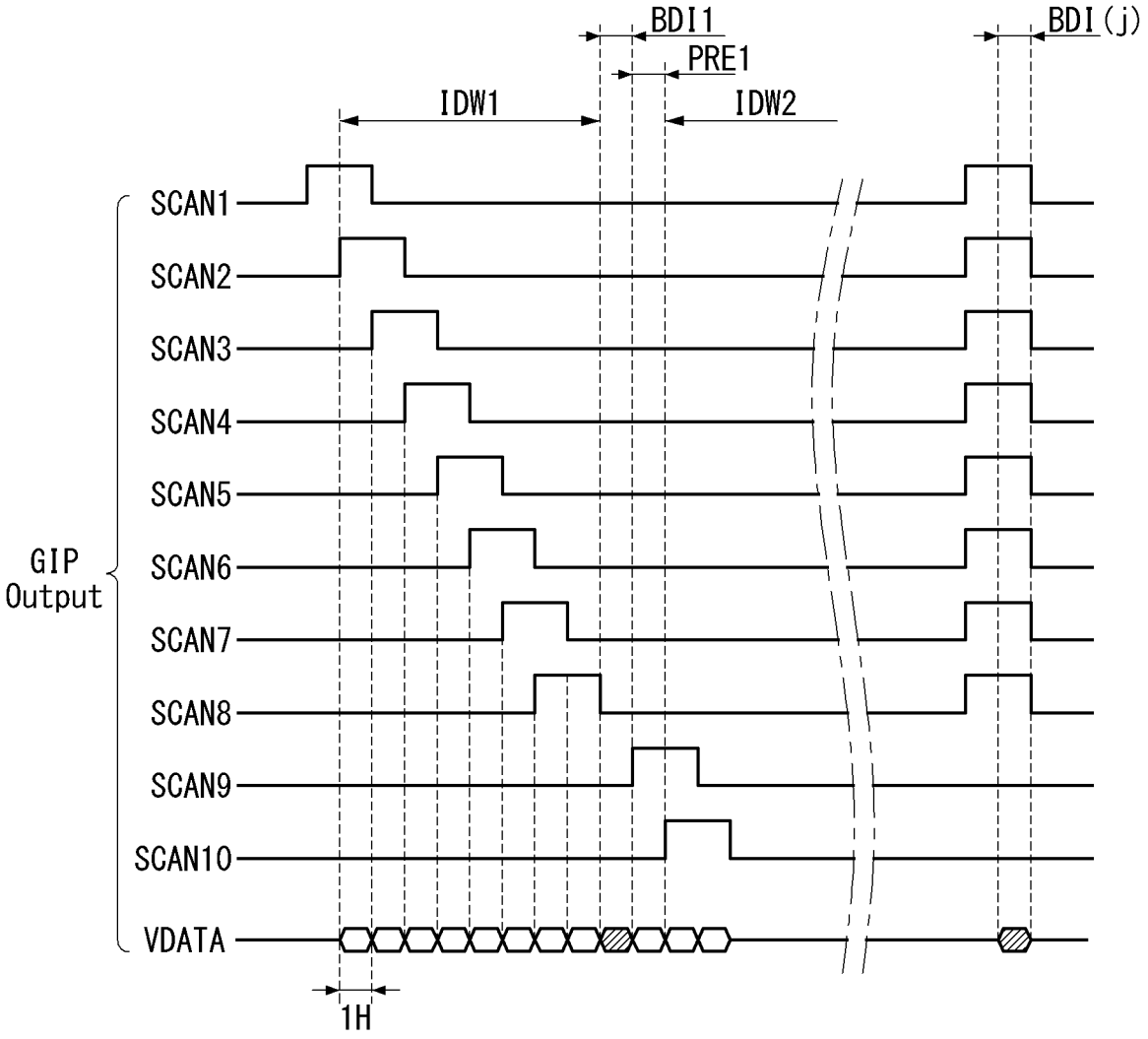
Figure 5:
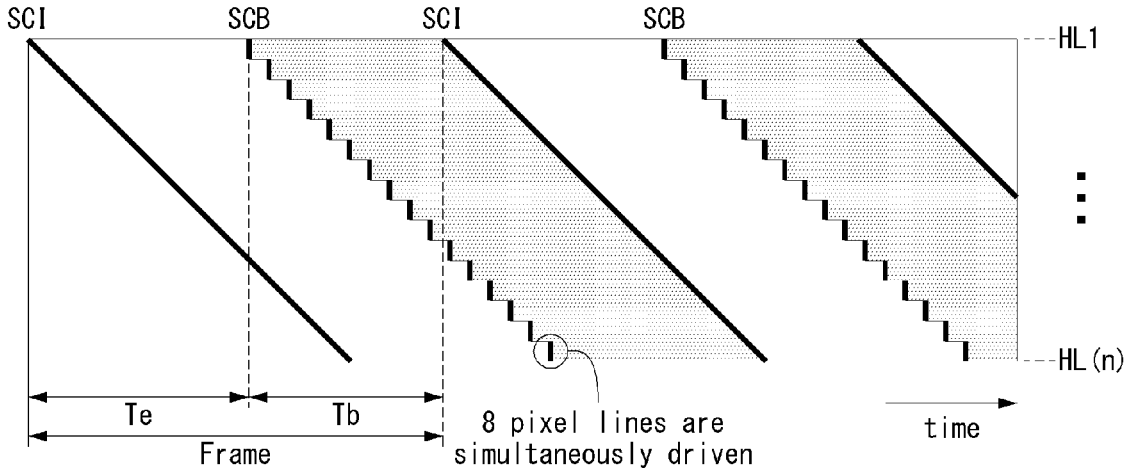

FIG. 3 is a view illustrating a scan signal and a sense signal applied to a first pixel line according to an embodiment of the present disclosure. FIG. 4 is a timing chart of first to tenth scan signals for BDI driving according to an embodiment of the present disclosure. FIG. 5 is a view illustrating, in units of frames, a timing at which scan signals for BDI driving are applied according to an embodiment of the present disclosure.

BDI driving of the pixels electrically connected to the first data line will be described with reference to FIGS. 2 to 5.

Each of the scan signals and the sense signals is set to an output period of 2H or more and overlap driving is performed. The output period of the scan signals and sense signals refers to a period during which a turn-on voltage is maintained. The 1H period refers to a period of writing a data voltage into the pixels arranged in one pixel line HL. Each of the scan signals includes a scan signal SCI for data writing and a scan signal SCB for BDI.

An image data write interval refers to an interval during which data is sequentially written into the horizontal lines belonging to one group. A BDI interval refers to an interval during which black data is simultaneously written into horizontal lines belonging to one group. The number of horizontal lines belonging to one group may vary according to the design. Hereinafter, the present embodiment will be described with reference to an embodiment in which eight horizontal lines are set as one group.

During the first image data write interval IDW1, the scan signals SCI for data writing of the first to eighth scan signals SCAN1 to SCAN8 are sequentially applied to the display panel DIS. The first scan signal SCAN1 is applied to the first scan line SLA1 and the second scan signal SCAN2 is applied to the second scan line SLA2. Similarly, the eighth scan signal SCAN8 is applied to the eighth scan line SLAB. During the first image data write interval IDW1, data voltage VDATA for image display is supplied to the first data line DL1 in synchronization with the scan signals SCI for displaying an image.

During a first BDI interval BDI1 of the 1H period, the scan signals SCB for BDI are simultaneously applied to eight contiguous pixel lines. The scan signals for BDI applied to first to eighth pixel lines HL1 to HL8 may be applied during the BDI interval BDI(j) (j is a certain natural number equal to or smaller than "n/8"). During the BDI interval, a data voltage for displaying a black image is applied to the data line DL.

A first precharge interval PRE1 of the 1H period is an interval for precharging a ninth pixel line HL9 using a ninth scan signal SCANS.

The operation of the first pixel during a programming interval Tp, a light emission interval Te, and the BDI interval BDI illustrated in FIG. 3 will be described.

Figure 6:
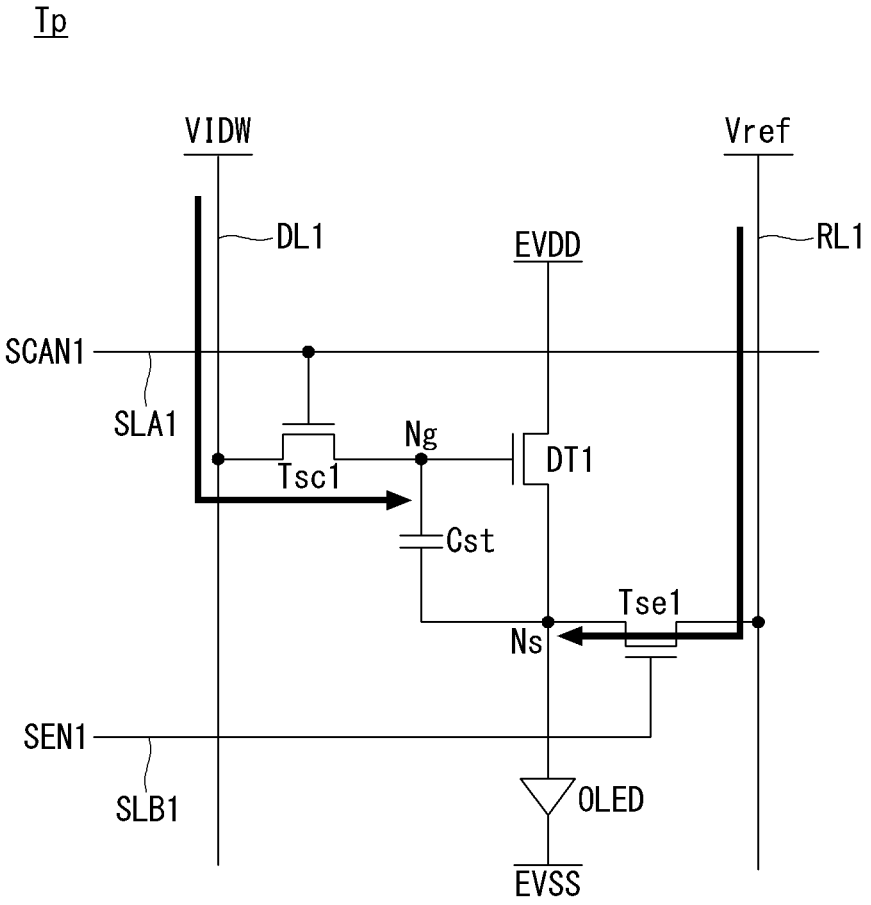
FIG. 6 is an equivalent circuit diagram of a pixel during a programming interval according to an embodiment of the present disclosure.
Figure 7:
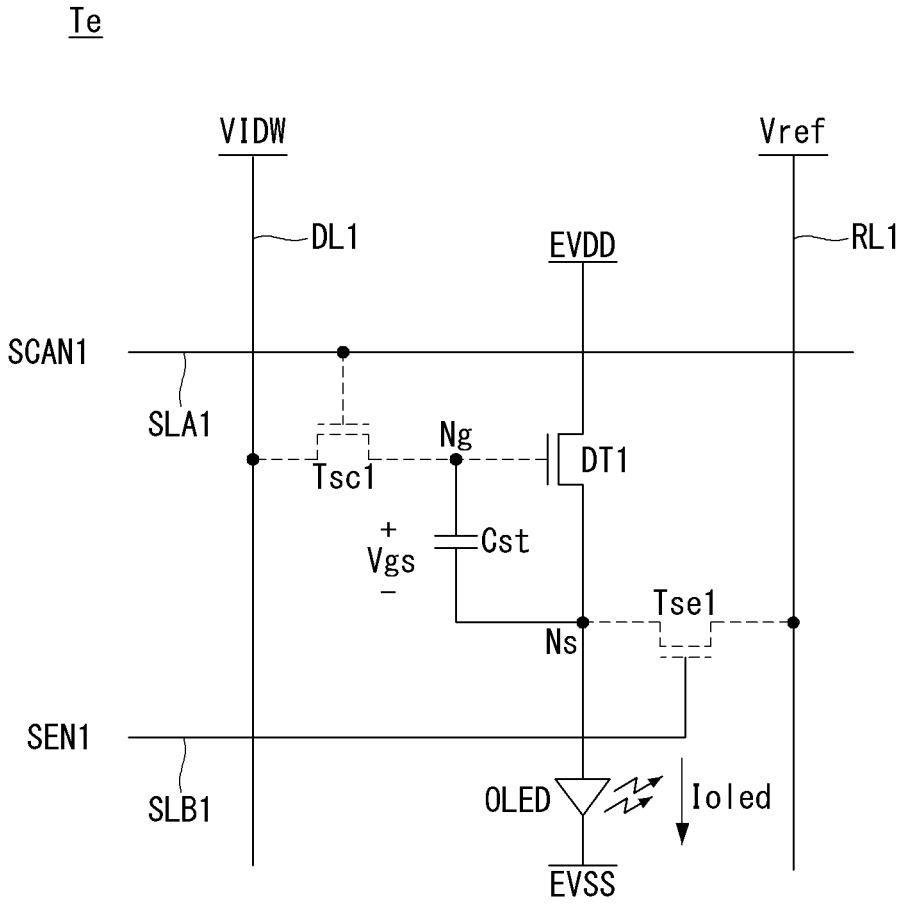
FIG. 7 is an equivalent circuit diagram of a pixel during a light emission interval according to an embodiment of the present disclosure.
Figure 8:
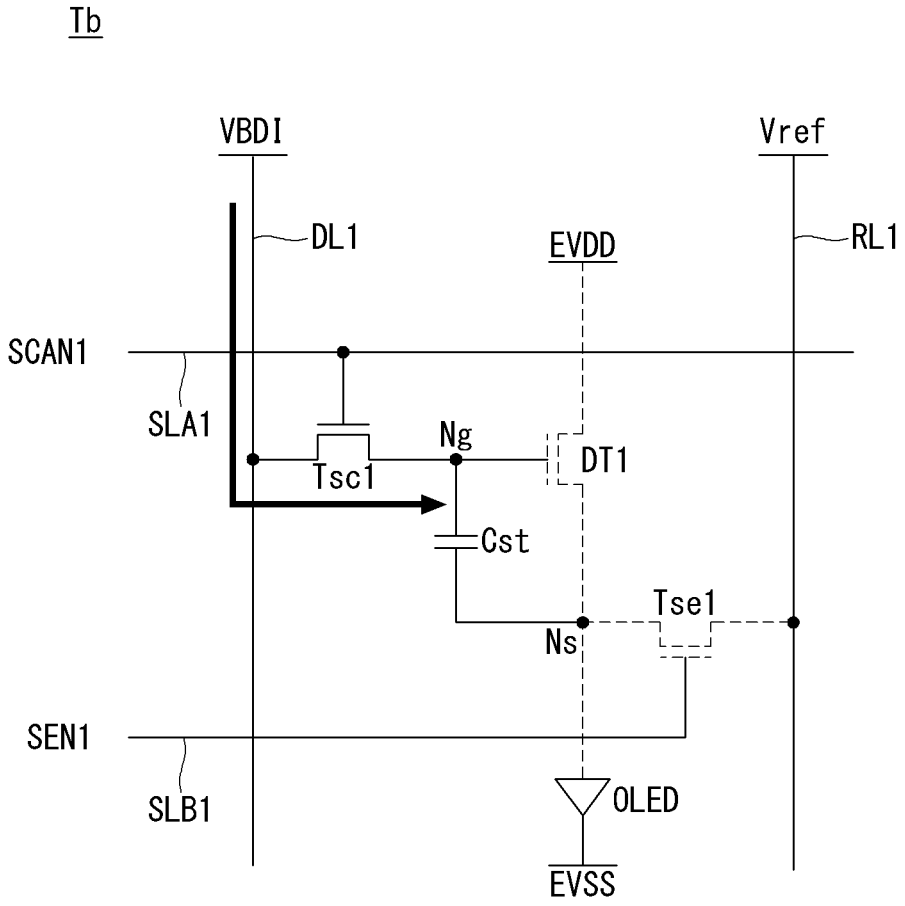
FIG. 8 is an equivalent circuit diagram of a pixel during a black data insertion interval according to an embodiment of the present disclosure.

FIG. 6 is an equivalent circuit diagram of the first pixel corresponding to the programming interval according to an embodiment of the present disclosure, and FIG. 7 is an equivalent circuit diagram of the first pixel corresponding to the light emission interval according to an embodiment of the present disclosure. FIG. 8 is an equivalent circuit diagram of the first pixel corresponding to the black data insertion interval according to an embodiment of the present disclosure.

Referring to FIG. 6, during the programming interval Tp, the first scan transistor Tsc1 applies a data voltage VIDW for image data writing to the first node Ng in response to the scan signal SCI for image data writing. During the programming interval Tp, the first sense transistor Tse1 is turned on according to the sense signal SEN1 to apply a reference voltage Vref to the second node Ns. Accordingly, during the programming interval Tp, a voltage between the first node Ng and the second node Ns of the first pixel P1 is set to fit a desired pixel current.

Referring to FIG. 7, during the light emission interval Te, the first scan transistor Tsc1 and the first sense transistor Tse1 are turned off. The voltage Vgs between the first node Ng and the second node Ns during the programming interval Tp is also maintained during the light emission interval Te. Since the voltage Vgs between the first node Ng and the second node Ns is larger than a threshold voltage of the driving transistor DT1 during the light emission interval Te, a pixel current Ioled flows through the driving transistor DT1. A potential of the first node Ng and a potential of the second node Ns are boosted, while maintaining the magnitude of "Vgs," by the pixel current Ioled. When the potential of the second node Ns is boosted up to an operating point level of the organic light emitting diode OLED, the organic light emitting diode OLED emits light.

Referring to FIG. 8, during the BDI interval Tb, the first scan transistor Tsc1 is turned on in response to the scan signal SCB for BDI to apply the data voltage VBDI for BDI to the first node Ng. During the BDI interval Tb, the first sense transistor Tse1 maintains the turn-off state, and thus, the potential of the second node Ns maintains the operating point level of the organic light emitting diode OLED. The data voltage VBDI for BDI is lower than the operating point level of the organic light emitting diode OLED. Therefore, since the voltage Vgs between the first node Ng and the second node Ns is smaller than the threshold voltage of the driving transistor DT1 during the BDI interval Tb, the pixel current Ioled does not flow at the driving transistor DT1 of the first pixel P1 and the organic light emitting diode OLED stops emitting light.

As described above, brightness of the organic light emitting diode OLED during the light emission interval Te is determined by the voltage difference Vgs between the first node Ng and the second node Ns of the driving transistor DT set during the programming interval Tp. Therefore, the voltage set to the second nodes Ns of all the pixels P during the programming interval Tp should be the same. Ideally, the second node Ns of each pixel is set to the reference voltage Vref, but an "IR deviation" proportional to "I×R" size due to current between the reference voltage line and the second node Ns often occurs. If the IR deviation having the same size occurs in all the pixels P, a luminance deviation does not occur between the pixels, but the luminance deviation occurs if the sizes of "IR deviation" are different.

In the present disclosure, in order to improve the difference in size of the "IR deviation" between the adjacent pixels, reference voltage lines electrically connected to the pixels of an odd-numbered pixel line and the pixels of an even-numbered pixel line are separated. This will now be described.

Figure 9:
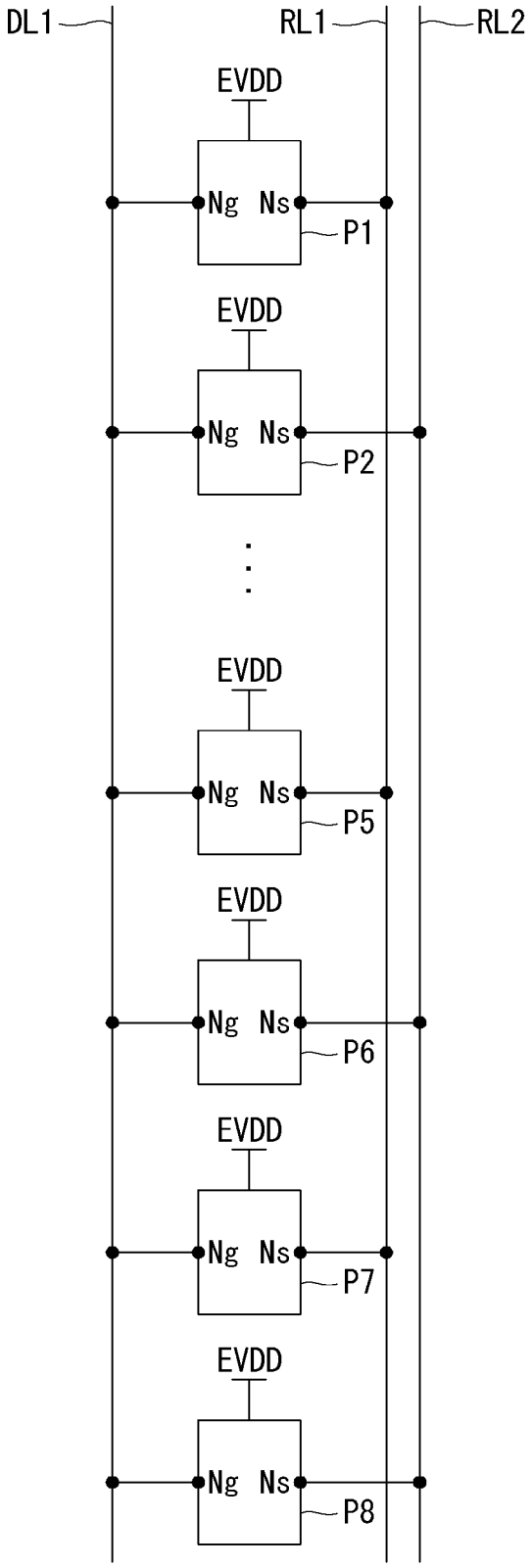
FIG. 9 is a view illustrating pixels arranged in a first column line according to an embodiment of the present disclosure.
Figure 10:
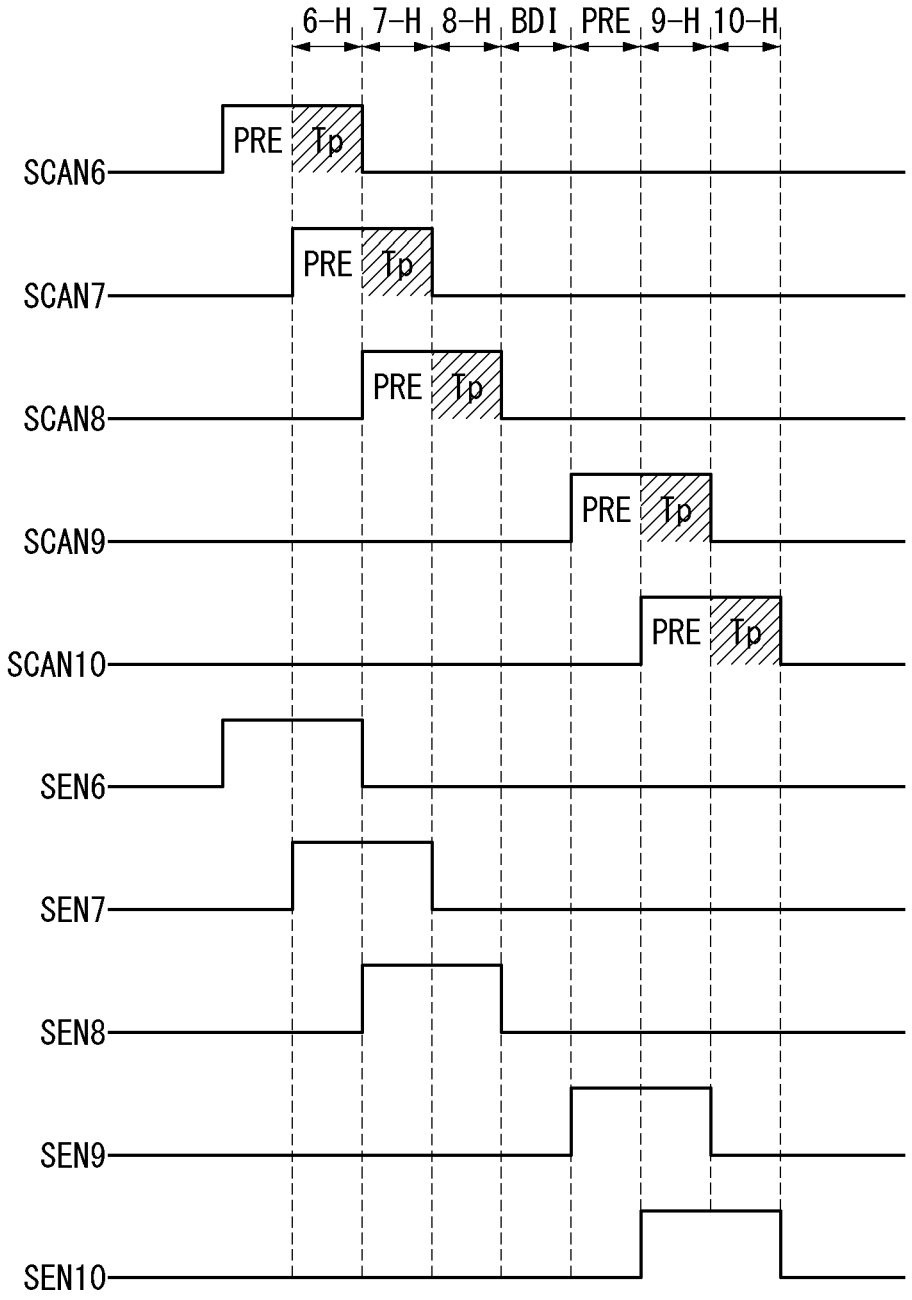
FIG. 10 is a view illustrating scan signals and sense signals during sixth to tenth horizontal periods according to an embodiment of the present disclosure.

FIG. 9 is a view illustrating pixels arranged in a first column line in a pixel array according to an embodiment of the present disclosure. FIG. 10 is a view illustrating sixth to tenth scan signals and sense signals applied during sixth to tenth horizontal periods according to an embodiment of the present disclosure.

Referring to FIG. 9, the odd-numbered pixels P1, P5, and P7 among the pixels electrically connected to the first data line DL1 are electrically connected to a first reference voltage line RL1, and even-numbered pixels P2, P6, and P8 are electrically connected to a second reference voltage line RL2. Stated differently, the pixels electrically connected to the first data line DL1 includes a first set of pixels that are electrically connected to the first reference voltage line RL1, and as second set of pixels that are electrically connected to the second reference voltage line RL2. Each of the first set of pixels is spaced from another one of the first set of pixels by one of the second set of pixels. As a result, the first set of pixels and the second set of pixels are positioned in an alternating fashion as shown, for example, in FIG. 9.

In FIG. 10, a sixth horizontal period 6-H is a programming interval of a pixel P6 (hereinafter, referred to as a sixth pixel) arranged in a sixth pixel line. A seventh horizontal period 7-H is a programming interval of a pixel P7 (hereinafter, referred to as a seventh pixel) arranged in a seventh pixel line and an eighth horizontal period 8-H is a programming interval of a pixel P8 (hereinafter, referred to as an eighth pixel). As illustrated in FIG. 10, when overlap driving is performed, the programming interval Tp of a k-th pixel k (k is a natural number equal to or smaller than n) and the precharge interval PRE of a (k+1)-th pixel overlap. For example, the programming interval Tp of the sixth pixel P6 and the precharge interval PRE of the seventh pixel P7 overlap in the sixth horizontal period 6-H. Here, a period after the eighth horizontal period 8-H in the first image data write interval IDW1 is a BDI interval, and thus, the programming interval Tp of the eighth pixel 8P does not overlap the precharge interval of the ninth pixel P9.

Figure 11:
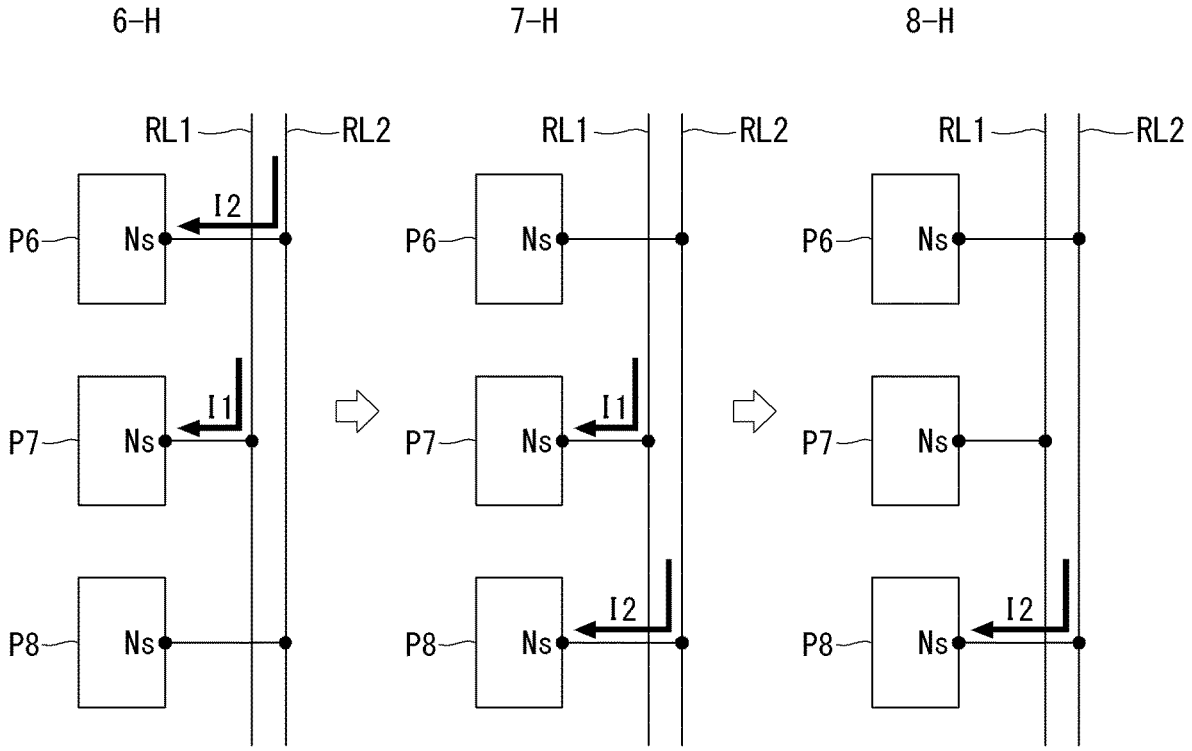
FIG. 11 is a view illustrating IR deviation of pixels according to an embodiment of the present disclosure.

FIG. 11 is a view illustrating the IR deviations of the sixth to eighth pixels according to an embodiment of the present disclosure.

Referring to FIGS. 10 and 11, during the sixth horizontal period 6-H, the sixth and seventh sense signals SEN6 and SEN7 are turn-on voltages. Accordingly, the sixth pixel P6 is supplied with the reference voltage Vref from the second reference voltage line RL2. As a result, the second node Ns of the sixth pixel P6 is set to a voltage having an "IR deviation" having the size of "I2×R2" from the reference voltage Vref. Here, "I2" refers to current flowing through the second reference voltage line RL2, and "R2" refers to a resistance value of the second reference voltage line RL2. The seventh pixel P7 is supplied with the reference voltage Vref from the first reference voltage line RL1. A voltage having an "IR deviation" having the size of "I1×R1" from the reference voltage Vref is applied to the second node Ns of the seventh pixel P7. Here, "I1" refers to the current flowing through the first reference voltage line RL1, and "R1" refers to the resistance value of the first reference voltage line RL1.

Since the first reference voltage line RL1 and the second reference voltage line RL2 output the same reference voltage Vref, if "R1" and "R2" are equal as "R," "I1" and "I2" are also equal. As a result, the voltage of the second node Ns of the sixth pixel P6 and the voltage of the second node Ns of the seventh pixel P7 have the same "IR deviation" having the size of "I×R" from the reference voltage Vref.

During the seventh horizontal period 7-H, the seventh and eighth sense signals SEN7 and SEN8 are turn-on voltages. Accordingly, the seventh pixel P7 is supplied with the reference voltage Vref from the first reference voltage line RL1 and the eighth pixel P8 is supplied with the reference voltage Vref from the second reference voltage line RL2. As a result, the voltage of the second node Ns of the seventh pixel P7 and the voltage of the second node Ns of the eighth pixel P8 have the same "IR deviation" having the size of "I×R" from the reference voltage Vref.

During the eighth horizontal period 8-H, the eighth sense signal SEN8 is a turn-on voltage and the ninth sense signal SEN9 is a turn-off voltage. Thus, the eighth pixel P8 is supplied with the reference voltage Vref from the second reference voltage line RL2. As a result, the voltage of the second node Ns of the eighth pixel P8 is set to have the "IR deviation" having the size of "I×R" from the reference voltage Vref.

As described above, in the present disclosure, reference voltage lines electrically connected to adjacent pixels are different. Therefore, in the programming process of the first pixel P1, although overlap driving is performed, the first pixel P1 does not have the "IR deviation" due to the precharge of the second pixel P2. As a result, the voltage of the second node Ns of each of the pixels according to the present disclosure is set to have the same "IR deviation" from the reference voltage Vref during the programming interval Tp. That is, since the "IR deviation" having the same size occurs in all the pixels, no brightness deviation (or luminance deviation) occurs between adjacent lines.

This will now be described together with a comparative example.

Figure 12:
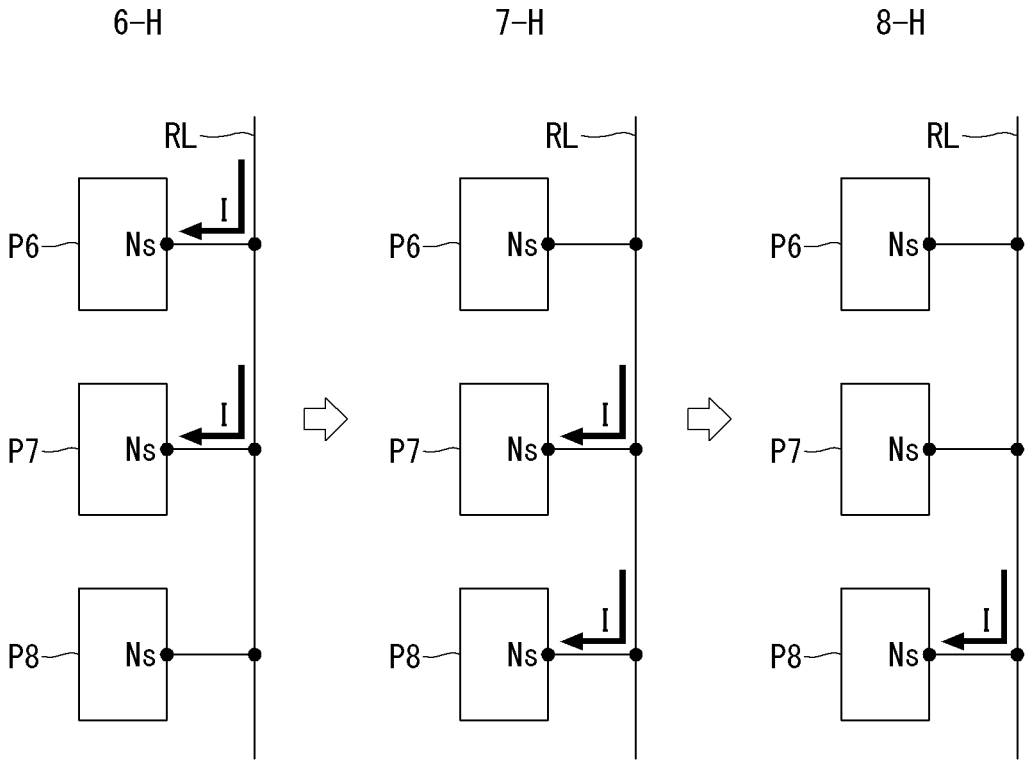
FIG. 12 is a view illustrating IR deviation of pixels according to a comparative example.

FIG. 12 is a view illustrating a programming operation of pixels according to a comparative example.

Referring to FIG. 12, in a pixel array according to the comparative example, the sixth to eighth pixels P6, P7 and P8 are electrically connected to the same reference voltage line RL. Although not illustrated in FIG. 12, the sixth to eighth pixels P6, P7 and P8 are electrically connected to the same data line. The scan signals and the sense signals of the pixels illustrated in FIG. 12 have the timing illustrated in FIG. 10.

Referring to FIGS. 10 and 12, during the sixth horizontal period 6-H, the sixth and seventh sense signals SEN6 and SEN7 are turn-on voltages, and thus, current flows between the second node Ns of the sixth and seventh pixels P6 and P7 and the reference voltage line RL. As a result, the second node Ns of the sixth pixel P6 and the second node Ns of the seventh pixel P7 are set to a voltage having the "IR deviation" having the size of "2I×R" from the reference voltage Vref. Here, "I" refers to a current value flowing to the second node Ns of each of the pixels from the reference voltage line RL, and "R" refers to a resistance value of the reference voltage line RL.

During the seventh horizontal period 7-H, the seventh and eighth sense signals SEN7 and SEN8 are turn-on voltages, and accordingly, current flows between the second node Ns of the seventh and eighth pixels P7 and P8 and the reference voltage line RL. As a result, the second node Ns of the seventh pixel P7 and the second node Ns of the eighth pixel P8 are set to a voltage having the "IR deviation" having the size of "2I×R" from the reference voltage Vref.

During the eighth horizontal period 8-H, the eighth sense signal SEN is a turn-on voltage, and thus, current flows between the second node Ns of the eighth pixel P8 and the reference voltage line RL. Also, the second node Ns of the eighth pixel P8 is set to a voltage having the "IR deviation" having the size of "I×R" from the reference voltage Vref.

As described above, the second node Ns of the sixth pixel P6 and the second node Ns of the seventh pixel P7 are programmed in a state of having the voltage deviation of "2I×R" from the reference voltage Vref, whereas the second node Ns of the eighth pixel P8 is programmed in a state of having the "IR deviation" having the size of "I×R" from the reference voltage Vref. Thus, although the same data voltage is applied to the sixth to eighth pixels P6 to P8, the eighth pixel P8 programmed in the eighth horizontal period 8-H represents different brightness as compared with the sixth and seventh pixels P6 and P7.

In contrast, since the pixels according to the present disclosure have the same "IR deviation" from the reference voltage Vref during the programming interval, the difference in brightness due to the "IR deviation" may be improved.

Figure 13:
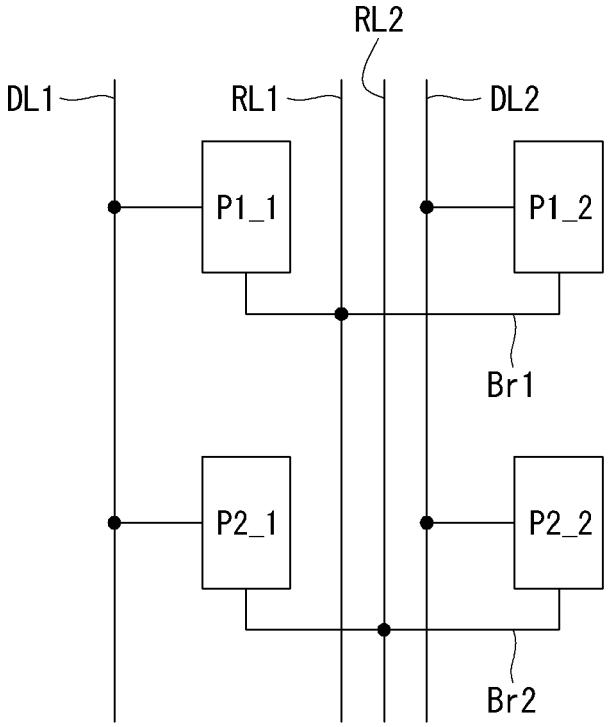
FIGS. 13 and 14 are views illustrating an arrangement of first and second reference voltage lines according to embodiments of the present disclosure.
Figure 14:
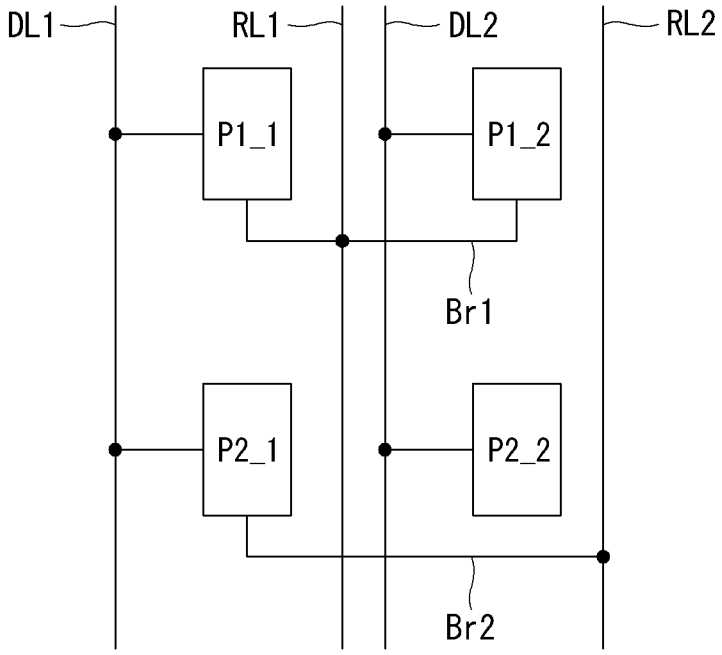

FIGS. 13 and 14 are views illustrating embodiments in which reference voltage lines are arranged according to embodiments of the present disclosure.

Referring to FIG. 13, (1-1)-th pixel P1_1 and (2-1)-th pixel P2_1 are electrically connected to the first data line DL1, and (1-2)-th pixel P1_2 and (2-2)-th pixel P2_2 are electrically connected to the second data line DL2. The first reference voltage line RL1 and the second reference voltage line RL2 may be positioned between the pixels P1_1 and P2_1 arranged in the first column line and the pixels P1_2 and P2_2 arranged in the second column line.

The (1-1)-th pixel P1_1 and the (1-2)-th pixel P1_2 arranged in the odd-numbered pixel line are electrically connected to the first reference voltage line RL1 through a first bridge Br1. The (2-1)-th pixel P2_1 and the (2-2)-th pixel P2_2 arranged in the even-numbered pixel line are electrically connected to the second reference voltage line RL2 through a second bridge Br2.

As described above, the plurality of pixels arranged on the same pixel line may be electrically connected to the first reference voltage line RL1 or the second reference voltage line RL2 through the first bridge Br1 or the second bridge Br2. The number of pixels electrically connected to the first reference voltage line RL1 or the second reference voltage line RL2 may be two or more and may be set in consideration of RC delay.

Referring to FIG. 14, (1-1)-th pixel P1_1 and (1-2)-th pixel P1_2 disposed in the odd-numbered pixel line are electrically connected to a first reference voltage line RL1 through a first bridge Br1. (2-1)-th pixel P2_1 and (2-2)-th pixel P2_2 arranged in the even-numbered pixel line are electrically connected to a second reference voltage line RL2 through a second bridge Br2. The second reference voltage line RL2 may be spaced apart from the first reference voltage line RL1 with the pixels P1_2 and P2_2 disposed in the second column line interposed therebetween.

The present disclosure may improve the variation of the IR deviation of the reference voltage applied to the pixels. The present disclosure allows all pixels to have the same size of IR deviation, so that the reference voltage applied to the pixels may be the same. As a result, the present disclosure may improve the occurrence of brightness deviation between pixels.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An organic light emitting display device, comprising:
a first data line;
a first reference voltage line;
a second reference voltage line;
a plurality of pixels electrically connected to the first data line, wherein the plurality of pixels are n pixels and divided into a first set of pixels and a second set of pixels, each of the first set of pixels is electrically connected to the first data line and the first reference voltage line, each of the second set of pixels is electrically connected to the first data line and the second reference voltage line, each of the first set of pixels is spaced from another one of the first set of pixels by one of the second set of pixels, and the first and second reference voltage lines are configured to receive a reference voltage having the same voltage level; and
a gate driver configured to, during an image data write interval, provide scan signals and sense signals to perform overlap driving of a k-th pixel and a (k+1)-th pixel of the plurality of pixels, and perform overlap driving of a n-th pixel and a (n+1)-th pixel of the plurality of pixels, wherein n is a natural number larger than or equal to 2, and k is a natural number smaller than n, wherein the driving of the (k+1)-th pixel and the driving of the n-th pixel are non-overlap driven.

2. The organic light emitting display device of claim 1, wherein
the first set of pixels includes a first pixel including a first organic light emitting diode (OLED) and a first driving transistor;
the second set of pixels includes a second pixel including a second OLED and a second driving transistor;
the first reference voltage line is electrically connected to a source electrode of the first driving transistor; and
the second reference voltage line is electrically connected to a source electrode of the second driving transistor.

3. The organic light emitting display device of claim 2, further comprising:
an additional first pixel electrically connected to a second data line and electrically connected to the same scan line and sense line as that of the first pixel;
an additional second pixel connected to the second data line and connected to the same scan line and sense line as that of the second pixel;
a first bridge electrically connecting the additional first pixel to the first reference voltage line; and
a second bridge electrically connecting the additional second pixel to the second reference voltage line.

4. The organic light emitting display device of claim 2, wherein a drain electrode of each of the first and second driving transistors is electrically connected to an input terminal of a high potential driving voltage.

5. The organic light emitting display device of claim 4, wherein
the first data line is configured to supply a data voltage to a gate electrode of each of the first and second driving transistors; and
brightness of each of the first and second pixels is determined by a voltage difference between the gate electrode and the source electrode of each of the first and second driving transistors.

6. The organic light emitting display device of claim 5, wherein the first pixel includes a first scan transistor having a gate electrode electrically connected to a first scan line, a drain electrode electrically connected to the first data line, and a source electrode electrically connected to the gate electrode of the first driving transistor;

the second pixel includes a second scan transistor having a gate electrode electrically connected to a second scan line, a drain electrode electrically connected to the first data line, and a source electrode electrically connected to the gate electrode of the second driving transistor; and a first scan signal applied to the first scan line and a second scan signal applied to the second scan line have a period of 2H or greater.

7. The organic light emitting display device of claim 6, wherein the first pixel includes a first sense transistor having a gate electrode electrically connected to a first sense line, a source electrode electrically connected to the first reference voltage line, and a drain electrode electrically connected to the source electrode of the first driving transistor;

the second pixel includes a second sense transistor having a gate electrode electrically connected to a second sense line, a source electrode electrically connected to the second reference voltage line, and a drain electrode electrically connected to the source electrode of the second driving transistor; and during an image data write interval during which input image data is written into the first and second pixels, a first sense signal applied to the first sense line is synchronized with the first scan signal and a second sense signal applied to the second sense line is synchronized with the second scan signal.

8. The organic light emitting display device of claim 1, wherein when the overlap driving is performed, a programming interval of the k-th pixel and a precharge interval of the (k+1)-th pixel overlap.

9. The organic light emitting display device of claim 8, wherein in a case where the non-overlap driving is performed, the programming interval of the n-th pixel does not overlap the precharge interval of adjacent pixels connected to the first data line.

10. The organic light emitting display device of claim 1, wherein the plurality of pixels are simultaneously provided with black image data during a black data insertion interval after the image data write interval; and the sense signals for the plurality of pixels are turned off during the black data insertion interval.

11. The organic light emitting display device of claim 10, wherein the plurality of pixels are simultaneously provided with scan signals, and data voltage for displaying a black image is applied to the first data line during the black data insertion interval.

12. The organic light emitting display device of claim 1, wherein data voltage for image display is supplied to the first data line in synchronization with the scan signals for the image display during the image data write interval.

* * * * *